United States Patent [19]

Clarke

[11] Patent Number: 4,739,790

[45] Date of Patent: Apr. 26, 1988

[54] VALVE SYSTEM

[76] Inventor: Derek W. Clarke, Bridge House, Bridge Cres, Torphins, Aberdeenshire, United Kingdom

[21] Appl. No.: 927,033

[22] Filed: Nov. 5, 1986

[30] Foreign Application Priority Data

Nov. 6, 1985 [GB] United Kingdom ..... 8527344

[51] Int. Cl.[4] ..... G05D 16/10; F16K 37/00

[52] U.S. Cl. ..... 137/113; 137/552; 137/556; 137/606; 137/883; 128/205.24

[58] Field of Search ..... 137/109, 113, 552, 556, 137/557, 606, 883, 885; 128/205.18, 205.24

[56] References Cited

U.S. PATENT DOCUMENTS

| | | | |
|---|---|---|---|
| 2,641,273 | 6/1953 | Siebens | 137/113 |
| 3,001,541 | 9/1961 | St. Clair | 137/113 |
| 3,224,455 | 12/1965 | Alfieri | 137/113 |
| 3,351,089 | 11/1967 | Garrahan | 137/606 X |
| 3,583,421 | 6/1971 | Treloar | 137/113 |
| 3,592,215 | 7/1971 | Davis | 137/113 |
| 3,633,606 | 1/1972 | Hay | 137/113 |
| 4,619,255 | 10/1986 | Spinosa et al. | 137/113 X |

*Primary Examiner*—Alan Cohan
*Assistant Examiner*—John Rivell
*Attorney, Agent, or Firm*—Reed Smith Shaw & McClay

[57] ABSTRACT

A valve system comprising a housing, a main inlet to the housing for pressurized fluid communicating with an outlet from the housing, an auxiliary inlet to the housing for pressurized fluid communicating with the outlet, valve means in the housing movable to open or close communication between the main inlet and the outlet and between the auxiliary inlet and the outlet, and means exposed to the exterior of the housing and actuated by the valve means for indicating the position of the valve means relative to the main inlet and the auxiliary inlet.

3 Claims, 3 Drawing Sheets

VALVE SYSTEM

This invention relates to a valve system.

When divers descend in a diving bell, gas for breathing is fed to the bell through an umbilical line from the surface. In the bell the line splits into two branches each of which terminates in a valve for connection of a line to an individual diver. The branches are also connected through shuttle valves to respective emergency gas supplies, so that on reduction of pressure in the umbilical line the shuttle valves connect the emergency supplies to the divers' lines. The branches are also interconnected through a further shuttle valve from which outlets extend to other facilities for the bell and to a valve for connection of a third diver's line.

In the event of a failure of one of the diver's lines, the unaffected divers are protected by virtue of the emergency supplies biassing the shuttle valves to allow flow of emergency gas. The diver whose line has failed relies on his own portable gas supply which provides a back-up. Similarly a failure of the umbilical results in the shuttle valves moving to prevent gas flow to the umbilical in a reverse direction and allowing flow of the emergency gas to the divers.

There are several problems with this previously-proposed system:

1. The emergency supplies must either be shut off in normal operation or the pressure must be reduced to below that of the normal umbilical supply. This is to ensure that in normal diving the emergency supplies are not consumed.
2. There is no indication as to when gas is being supplied from the emergency supply. Even with a pressure differential of 2 bar between the normal supply and the emergency supply, very high breathing rates can generate local pressure reductions in the pipework commensurate with the differential. Thus the emergency supply will then automatically open the non return and pass gas. Thus, during a deep dive or one in which the diver works hard, the emergency supply bottle can be drained down without any positive warning.
3. The shuttle valves between the umbilical and emergency supplies can "float" between its extreme positions, allowing gas to pass from both supplies at the same time.

According to the present invention there is provided a valve system comprising main inlet means for pressurised fluid communicating with first and second outlets; first and second auxiliary inlets for pressurised fluid communicating with the first and second outlets respectively; first valve means movable to open or close communication between the main inlet means and the first outlet and between the first auxiliary inlet and the first outlet; and second valve means movable to open or close communication between the main inlet means and the second outlet and between the second auxiliary inlet and the second outlet; said first and second valve means each preventing simultaneous communication of the main inlet means and the respective auxiliary inlet with the respective outlet.

Further according to the invention there is provided a valve system comprising main inlet means for pressurised fluid communicating with first and second outlets; first and second auxiliary inlets for pressurised fluid communicating with the first and second outlets respectively; first valve means movable to open or close communication between the main inlet means and the first outlet and between the first auxiliary inlet and the first outlet; and second valve means movable to open or close communication between the main inlet means and the second outlet and between the second auxiliary inlet and the second outlet; and means indicating the open and closed positions of the first and second valve means.

Preferably a further valve is disposed between the first and second outlets to prevent passage of fluid between them when only one of the outlets is open to the auxiliary inlet. This further valve may be a shuttle valve.

Preferably also, the valve means are spring-biassed to close off communication between the outlets and the auxiliary inlets.

The indicating means may be audible or visual, and is preferably actuated by movement of the valve means; the actuation may be mechanical.

An embodiment of the present invention will now be described by way of example with reference to the accompanying drawings, in which.

Figure 1:
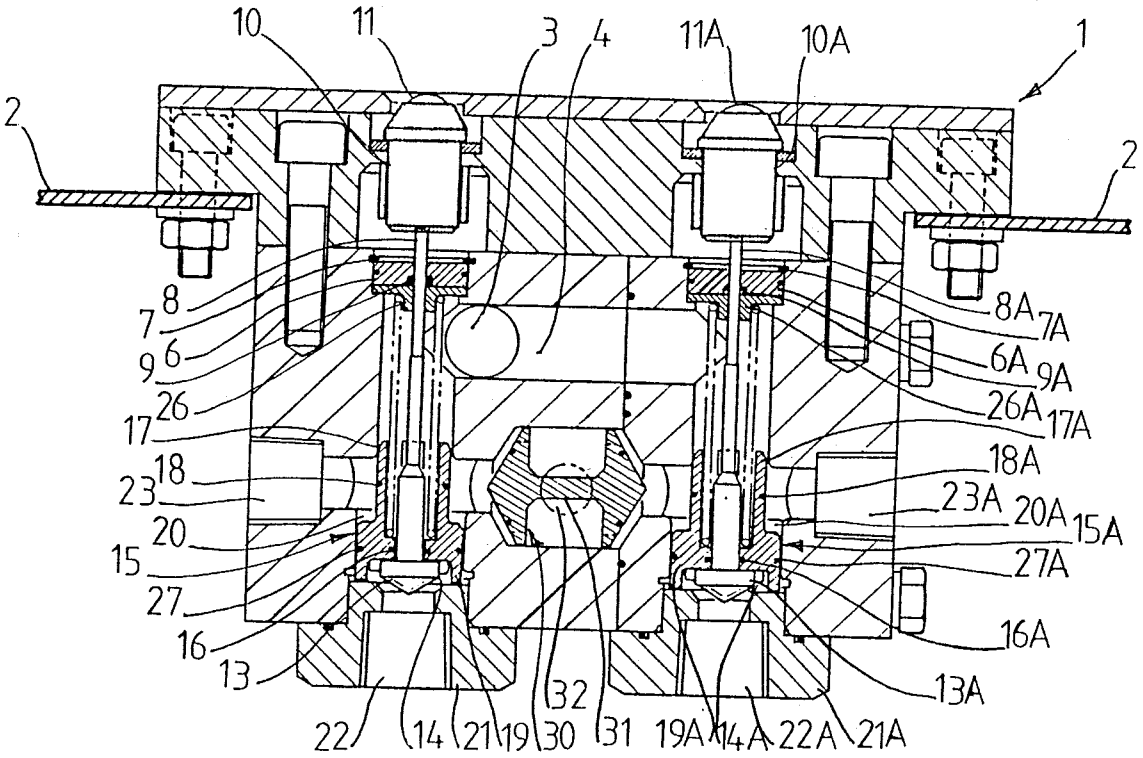
FIG. 1 is a sectional plan view of a valve system of the present invention.

Referring to the drawings, the system of this embodiment of the invention is housed within a valve block which is bolted on a panel 2 within a diving bell. The block 1 has an inlet 3 which is connected to a gas supply from the surface through an umbilical which also provides hot water and electricity to the bell.

The inlet 3 opens into a manifold 4 leading to first and second bores 5, 5A each of which is closed at its upper end in a gas-tight manner by an end plug 6, 6A which bears against a circlip 7, 7A. The plug 6, 6A is centrally apertured to allow a rod 8, 8A to pass through, the rod being axially movable and sealed against the plug 6, 6A by an O-ring seal 9, 9A.

The upper end of the rod 8, 8A engages with an indicator 10, 10A which normally presents a green outer face 11, 11A at the surface of the block 1. Movement of the rod 8, 8A towards the indicator 10, 10A causes a part-spherical red cover 12, 12A (see FIG. 3) to move over the green face 11, 11A thereby changing the displayed colour. The indicator 10, 10A is a proprietory item in pneumatic systems and is normally pneumatically rather than mechanically actuated.

The lower end of the rod 8, 8A carries a valve member 13, 13A which normally sits within a recess 14, 14A in the underside of a shuttle 15, 15A and is sealed against the shuttle 15, 15A by an O-ring seal 16, 16A. The shuttle 15, 15A has a small-diameter portion 17, 17A which carries an O-ring seal 18, 18A on its outer surface and which is a sliding fit in the bore 5, 5A, and a large-diameter portion 19, 19A which carries an O-ring seal on its outer surface and which is a sliding fit in a wide lower portion 20, 20A of the bore.

A retaining adaptor 21, 21A is screwed into the bottom of the bore to provide a stop for the shuttle 15, 15A, and the adaptor has a screw-threaded bore 22, 22A for receiving a connection to an emergency supply of gas from a pressurised cylinder located on the bell.

An outlet bore 23, 23A extends from the bore 5, 5A laterally through the block 1, and is screw-threaded at its outer end to receive a gas line extending to a diver's breathing apparatus.

A coil spring 24, 24A bears at one end against an end face of a recess 25, 25A in the shuttle 15, 15A and at its other end against a spring locator 26, 26A on the underside of the end plug 6, 6A to bias the shuttle 15, 15A towards the adaptor 21, 21A.

On the shuttle 15, 15A the distance between the O-ring seals 18, 18A and 27, 27A is greater than the diameter of the outlet bore 23, 23A, so that one or other of the seals is always in engagement with the wall of the bore 5, 5A.

Directly opposite to the outlet bore 23, 23A is a connecting bore 28 extending between the bores 5 and 5A. The connecting bore has a chamber 29 between its ends and a shuttle valve 30 is slidable within it to move between extreme positions in which it closes off fluid flow along the connecting bore 28. The shuttle valve 30 has a stem 31 adjacent which is an outlet bore 32 for receiving a further gas line extending to a diver's breathing apparatus.

When the valve system is to be used, the outlet bores 23 and 23A are connected to gas lines for divers who will leave the diving bell to perform subsea work, and the outlet bore 32 is connected to the gas line of a third diver who will remain in the bell to monitor operations. The pressure of gas through the inlet 3 and the force of the springs 24 and 24A bias the shuttles 15 and 15A into the positions shown in FIG. 1, so the O-ring seals 27 and 27A prevent fluid flow from the emergency supplies connected to the bores 22 and 22A through the adaptors 21 and 21A. There is therefore a clear pathway for gas from the umbilical through the inlet 3, along the manifold 4 and the bores 5 and 5A, past the shuttles 15 and 15A (which are castellated upstream of the O-ring seals 18 and 18A to assist flow) and through the outlet bores 23 and 23A to the outside divers. Equal pressure in the bores 5 and 5A also causes the shuttle valve 30 to "float" in the chamber 29, allowing gas to flow along the connecting bore 28 to the third diver. The shuttle valve 30 is also castellated for ease of gas flow.

In the above-described normal operation, the rods 8 and 8A are retracted from the indicators 10 and 10A which therefore both display the green outer faces 1 and 11A to the diver within the bell.

Figure 2:
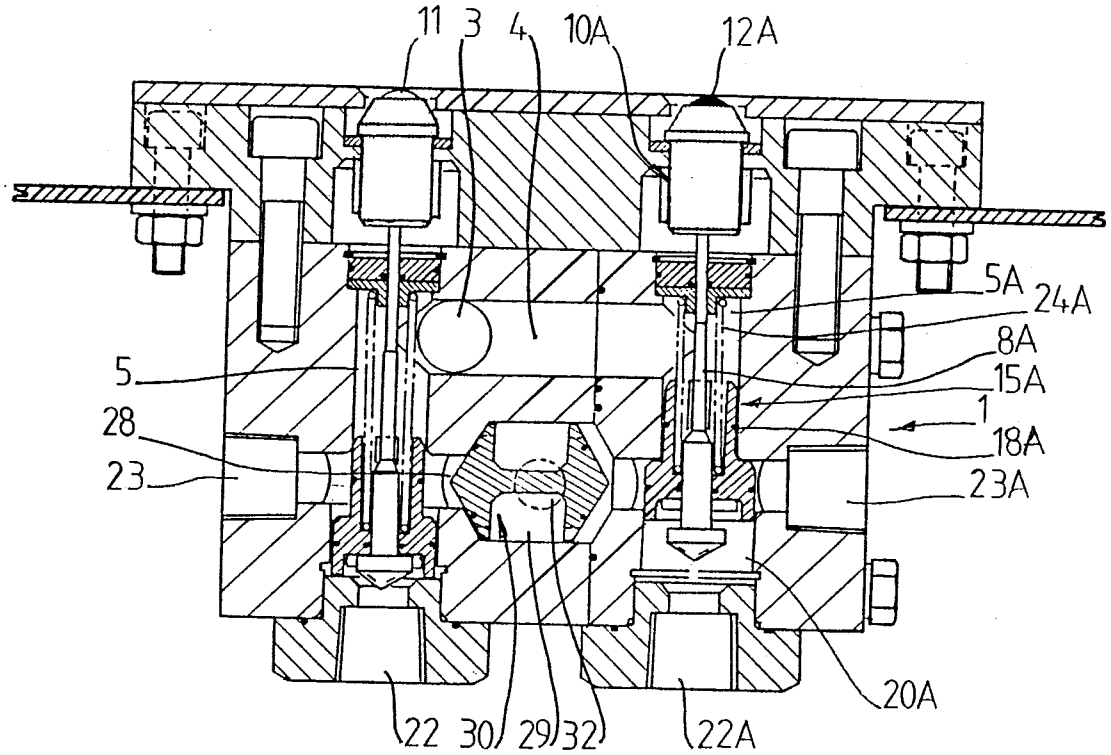
FIG. 2 shows the system of FIG. 1 in a first alternative mode.

FIG. 2 shows the operation of the system in the event of the gas line connecting the outside diver to the outlet bore 23 being damaged and leaking gas. That diver is himself protected by use of a portable gas supply which he carries with him, but the other outside diver must also be protected. The flow of gas from the umbilical follows the path of least resistance and flows rapidly to the severed line through the bore 5 and outlet bore 23, producing a pressure drop in the block 1 and starving the diver connected to the outlet bore 23A of gas. In this event the emergency supply connected to the bore 22A comes into operation, as the effect of its pressure on the underside of the shuttle 15A then exceeds the effect of the gas pressure plus the force of the spring 24A. This causes the shuttle 15A to move away from the adaptor 21A and into the narrow portion of the bore 5A, so that the O-ring seal 18A closes off the outlet bore 23A from the manifold 4. The O-ring seal 18A engages in the bore 5A before the O-ring seal 27A leaves the portion 20A, so gas cannot leak into the outlet bore 23A from the manifold 4 and the bore 22A simultaneously.

The movement of the shuttle 15A allows gas to flow from the emergency supply to the outlet bore 23A, thus ensuring a continuous supply to the diver. The pressure of this emergency gas also pushes the shuttle valve 30 against its seating in the connecting bore 28, closing off access through the connecting bore to prevent escape of emergency gas to the outlet bore 23 but providing emergency gas to the third diver through the outlet bore 32.

The shuttle's movement brings the rod 8A into actuating engagement with the indicator 10A so that the red cover 12A moves over the green face, indicating a fault to the third diver and warning him of the leakage in the outside diver's gas line.

Figure 3:
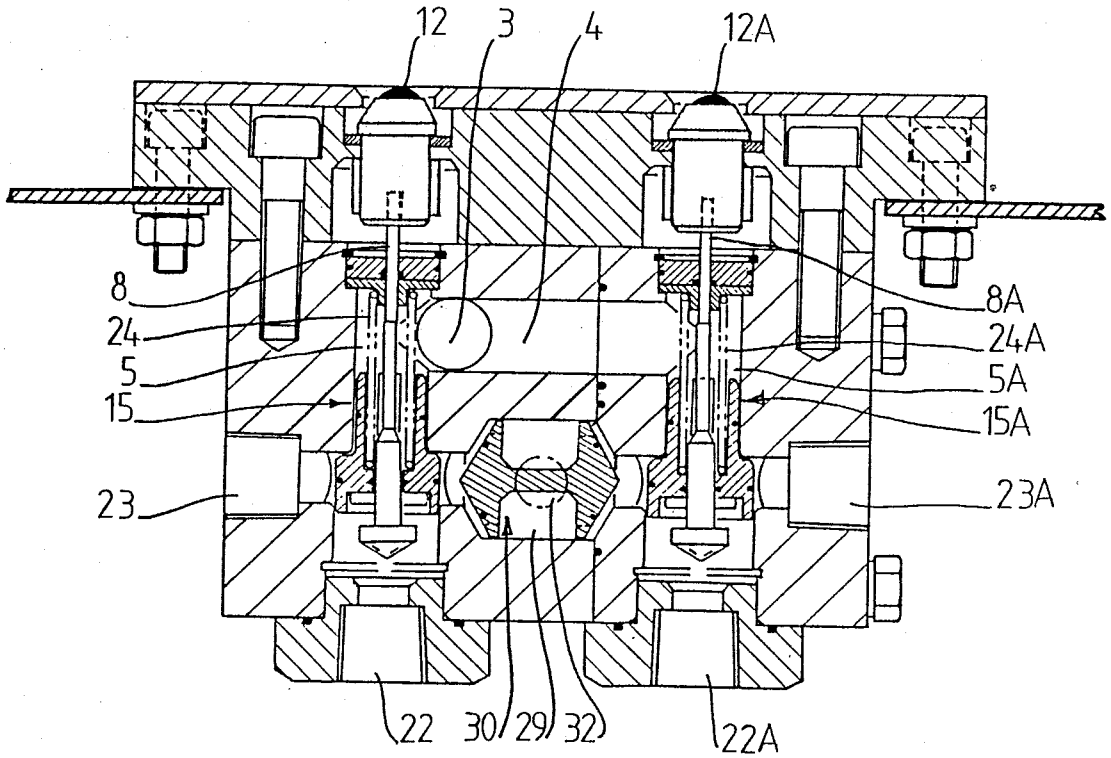
FIG. 3 shows the system of FIG. 1 in a second alternative mode.

In FIG. 3, pressure has been lost in the surface supply through the inlet 3, for example by severance of the umbilical. In this case there is a pressure drop in the manifold 4 and gas supply to the manifold 4 is cut off. The emergency gas supplies connected to the bores 22 and 22A then produce a force on the underside of both shuttles 15 and 15A greater than that of the gas above the shuttles plus the springs 24 and 24A. Both shuttles then move into the bores 5 and 5A, closing off fluid flow from the manifold 4 to the divers and opening communication between the bores 22 and 22A and the outlet bores 23 and 23A. The shuttle valve 30 remains floating in the chamber 29, and all three divers thus have their gas supply maintained. However, the switch to the emergency supply is clearly indicated to the diver in the bell by the rods 8 and 8A moving with the shuttles 15 and 15A into actuating engagement with the indicators 10 and 10A, causing the red covers 12 and 12A to be displayed.

In a further mode (not shown but with reference to FIG. 1) the umbilical has become "kinked" or otherwise constricted, so that pressure is initially maintained in the manifold 4 but continued flow of gas is prevented. In this case the outside divers continue to inhale gas from the bores 5 and 5A until the pressure in the manifold 4 reduces to an extent where the emergency gas acting on the underside of the shuttles 15 and 15A exerts a force slightly greater than that acting on the upper face of the shuttles 15 and 15A. The shuttles then move towards the bores 5 and 5A, and continued inhalation opens the bore 22 and 22A to the outlet bores 23 and 23A, allowing the divers to continue breathing. However, as gas is drawn from the emergency supply by the divers the pressure at the bores 22 and 22A momentarily drops, and the shuttles 15 and 15A return to a position where the O-ring seals 27 and 27A are just engaging the upper part of the bores 20 and 20A. Continued inhalation by the divers again lifts the shuttles 15 and 15A from the bores 20 and 20A, so that the divers again draw gas from the emergency supplies, and this oscillating movement of the shuttles 15 and 15A continues.

The effect of the oscillation is to cause the rods 8 and 8A to actuate and deactuate the indicators 10 and 10A, and the indicators thus display a "flashing" red and green to the diver in the bell.

Thus it will be seen that the valve system of this embodiment provides a safe and continuous gas supply to all three divers and prevents unintentional leakage of emergency gas. It also provides the diver in the bell with a clear indication of the status of the gas supplies to the divers.

Modifications and improvements may be made without departing from the scope of the invention.

I claim:

1. A valve system comprising:

(a) a housing, (b) a main inlet to the housing for pressurized fluid communicating with an outlet from the housing, (c) an auxiliary inlet to the housing for pressurized fluid communicating with the outlet, (d) valve means in the housing movable to open or close communication between the main inlet and the outlet and between the auxiliary inlet and the outlet, (e) means exposed to the exterior of the housing and actuated by the valve means for indicating the position of the valve means relative to the main inlet and the auxiliary inlet;

(f) said main inlet communicating with a second outlet from the housing, a second auxiliary inlet to the housing communicating with the second outlet and the second valve means in the housing movable to open or close communication between the main inlet and the second outlet and between the second auxiliary inlet and the second outlet and second indicating means being provided exposed to the exterior of the housing and actuated by the second valve means for indicating the position of the second valve means relative to the main inlet and the second auxiliary inlet; and (g) a further valve means being disposed in a communicating passage provided between the first and second outlets, the valve means operating to prevent passage between the outlets when one of the outlets is open to its respective auxiliary inlet.

2. A valve system as claimed in claim 1, wherein the further valve means is in the form of a shuttle valve.

3. A valve system as claimed in claim 2, wherein a third outlet is disposed in the communicating passage between the first and second outlets, the further valve means being adapted and arranged to prevent passage between one of the first or second outlets and the third outlet when the other of the first or second outlets is open to its respective auxiliary inlet.

* * * * *